US011632628B2

(12) United States Patent
Akiyama et al.

(10) Patent No.: US 11,632,628 B2
(45) Date of Patent: Apr. 18, 2023

(54) GLASS SHEET COMPOSITE

(71) Applicant: AGC Inc., Chiyoda-ku (JP)

(72) Inventors: Jun Akiyama, Tokyo (JP); Masayuki Hayashi, Tokyo (JP); Hikaru Ishida, Tokyo (JP)

(73) Assignee: AGC Inc., Chiyoda-ku (JP)

( * ) Notice: Subject to any disclaimer, the term of this patent is extended or adjusted under 35 U.S.C. 154(b) by 686 days.

(21) Appl. No.: 16/583,719

(22) Filed: Sep. 26, 2019

(65) Prior Publication Data

US 2020/0021916 A1 Jan. 16, 2020

Related U.S. Application Data

(63) Continuation of application No. PCT/JP2018/013060, filed on Mar. 28, 2018.

(30) Foreign Application Priority Data

Mar. 29, 2017 (JP) ..... JP2017-065571

(51) Int. Cl.
*H04R 7/20* (2006.01)
*H04R 7/04* (2006.01)
*H04R 7/06* (2006.01)

(52) U.S. Cl.
CPC ..... *H04R 7/06* (2013.01); *H04R 7/20* (2013.01); *H04R 2307/023* (2013.01)

(58) Field of Classification Search
CPC ..... H04R 7/00; H04R 7/02; H04R 7/04; H04R 7/06; H04R 7/08; H04R 7/10; H04R 7/16;

(Continued)

(56) References Cited

U.S. PATENT DOCUMENTS 5,812,684 A * 9/1998 Mark ..... G10K 11/178 381/71.4
6,003,766 A * 12/1999 Azima ..... B42D 15/022 235/379

(Continued)

FOREIGN PATENT DOCUMENTS

CN 1289220 A * 3/2001 ..... H04R 19/005
CN 1525787 A * 9/2004 ..... H04R 7/18

(Continued)

OTHER PUBLICATIONS

International Search Report dated Jun. 26, 2018 in PCT/JP2018/013060 filed Mar. 28, 2018 (with English Translation).

(Continued)

*Primary Examiner* — Edgardo San Martin
(74) *Attorney, Agent, or Firm* — Oblon, McClelland, Maier & Neustadt, L.L.P.

(57) ABSTRACT

The purpose of the present invention is to provide a glass sheet composite having satisfactory acoustic performance. The present invention relates to a glass sheet composite including a diaphragm that is vibrated by a vibrator, and a support member that is attached along an edge portion of the diaphragm to support the diaphragm, in which the diaphragm includes at least one glass sheet, and is supported on the support member through a fixing part that fixes the edge portion of the diaphragm to the support member, and a vibration-permitting part that permits vibration of the diaphragm.

19 Claims, 9 Drawing Sheets

(58) Field of Classification Search
CPC ..... H04R 7/18; H04R 7/20; H04R 7/22; H04R 2307/023
See application file for complete search history.

(56) References Cited

U.S. PATENT DOCUMENTS

| | | | | |
|---|---|---|---|---|
| 6,285,770 | B1 * | 9/2001 | Azima | B60R 11/0217 381/388 |
| 2004/0103588 | A1 * | 6/2004 | Allaei | E06B 5/205 52/204.5 |
| 2013/0241352 | A1 | 9/2013 | Hayashi et al. | |
| 2014/0161282 | A1 | 6/2014 | Norris | |
| 2015/0298656 | A1 * | 10/2015 | Pascoe | H04R 1/028 381/86 |
| 2018/0284328 | A1 * | 10/2018 | Kawai | G10K 13/00 |
| 2019/0030862 | A1 | 1/2019 | Akiyama | |

FOREIGN PATENT DOCUMENTS

| | | | | | |
|---|---|---|---|---|---|
| CN | 103703795 | A | | 4/2014 | |
| CN | 109076288 | A | | 12/2018 | |
| EP | 3 442 244 | A1 | | 2/2019 | |
| JP | 5-198375 | A | | 8/1993 | |
| JP | 2001-061194 | A | | 3/2001 | |
| JP | 2004120517 | A | * | 4/2004 | |
| JP | 2017011395 | A | * | 1/2017 | |
| JP | 2018170593 | A | * | 11/2018 | |
| JP | 2019068368 | A | * | 4/2019 | |
| WO | WO-2017175682 | A1 | * | 10/2017 | B32B 1/00 |

OTHER PUBLICATIONS

Written Opinion dated Jun. 26, 2018 in PCT/JP2018/013060 filed Mar. 28, 2018.
Extended European Search Report dated Dec. 8, 2020 in corresponding European Patent Application No. 18774472.7, 9 pages.

* cited by examiner

GLASS SHEET COMPOSITE

TECHNICAL FIELD

The present invention relates to a glass sheet composite including a glass sheet vibrating to thereby exhibit acoustic performance, and a support member attached along an edge portion of the glass sheet.

BACKGROUND ART

Generally, a cone paper or resin has been used as a diaphragm for loudspeakers or microphones. However, Patent Literature 1 discloses a loudspeaker in which a glass sheet is used in place of such a diaphragm.

Patent Literature 1 discloses a panel type loudspeaker combined with a flat display panel. The panel type loudspeaker according to Patent Literature 1 has a flat sheet-like diaphragm excited to vibrate by an exciter, and the diaphragm is configured to also serve as a constituent part of the flat display panel. Specifically, a glass sheet on the front surface side constituting a display device is also used as a diaphragm, and the glass sheet on the front surface side is supported on a frame body of the display device through a mediation layer having moderate rigidity.

That is, Patent Literature 1 discloses a glass sheet composite in which a glass sheet serving as a diaphragm is supported on a frame body corresponding to a support member, through a mediation layer having rigidity. In addition, in the glass sheet composite according to Patent Literature 1, since the support member is a frame body, all the peripheral edge portions of the four sides of the glass sheet serving as a diaphragm are supported on the frame body through the mediation layer.

CITATION LIST

Patent Literature

Patent Literature 1: JP-A-2001-61194

SUMMARY OF INVENTION

Technical Problem

However, in the glass sheet composite according to Patent Literature 1, when the glass sheet on the front surface side is vibrated, the vibration of the glass sheet is transmitted to the support member (frame body) through the mediation layer so that the support member also vibrates. Thus, there is a problem that the support member also generates sound. The problem leads to a problem that the glass sheet composite according to the Patent Literature 1 cannot obtain excellent acoustic performance.

For application of the glass sheet used as a diaphragm, it is assumed that the glass sheet is applied to a building material for a window, a wall, a ceiling or the like as well as the flat display panel disclosed in Patent Literature 1. In addition, the glass sheet serving as a diaphragm also has a function of attenuating noise by generating vibration with an opposite phase to the noise. Therefore, the glass sheet serving as a diaphragm is expected to be used widely, for example, in an indoor structure for a self-supported handrail or a smoke-proof hanging wall to be installed in a room so as to provide a noise attenuation function for the handrail or the smoke-proof hanging wall.

Further, the glass sheet serving as a diaphragm is generally not placed by itself in a place where the glass sheet should be applied but placed in a form in which all the peripheral edge portions of the four sides of the glass sheet are supported by a support member (for example, a glass sheet composite for a window) or in a form in which an edge portion of at least one side of the glass sheet is supported by a support member (for example, a glass sheet composite for a wall, a ceiling, a handrail or a smoke-proof hanging wall) in the place where the glass sheet should be applied.

In this manner, the glass sheet serving as a diaphragm is used in a form (glass sheet composite) in which an edge portion thereof is supported by a support member. As described in Patent Literature 1, however, due to the aforementioned problem, among glass sheet composites in the background art, there is no glass sheet composite capable of exhibiting sufficient acoustic performance. Therefore, a glass sheet composite with excellent acoustic performance has been desired.

The present invention has been developed in light of the aforementioned situation. An object of the present invention is to provide a glass sheet composite with excellent acoustic performance.

Solution for the Problem

To achieve the above object, present invention provides a glass sheet composite including a diaphragm that is vibrated by a vibrator, and a support member that is attached along an edge portion of the diaphragm to support the diaphragm, in which the diaphragm comprises at least one glass sheet, and is supported on the support member through a fixing part that fixes the edge portion of the diaphragm to the support member, and a vibration-permitting part that permits vibration of the diaphragm.

According to the glass sheet of the present invention, excellent acoustic performance is provided.

In one embodiment of the present invention, it is preferred that the diaphragm is formed into a rectangular shape having edge portions in four sides thereof; and the support member is formed into a frame-like body which can be attached along the edge portions of the four sides of the diaphragm.

In one embodiment of the present invention, it is preferred that the diaphragm is formed into a rectangular shape having edge portions in four sides thereof; and the support member is formed into a solid plate which can be attached to one side of the diaphragm.

In one embodiment of the present invention, it is preferred that the fixing part is disposed intermittently along the edge portion of the diaphragm.

T In one embodiment of the present invention, it is preferred that the fixing part is disposed in an edge portion near a corner portion of the diaphragm.

In one embodiment of the present invention, it is preferred that an area where the fixing part is disposed in the edge portion of the diaphragm is smaller than an area where the vibrati0018

In one embodiment of the present invention, it is preferred that the fixing part comprises a setting block on which the edge portion of the diaphragm is mounted, and a seal material which fixes the edge portion of the diaphragm to the support member.

In one embodiment of the present invention, it is preferred that the vibration-permitting part is a soft backer that is disposed between the edge portion of the diaphragm and the support member.

In one embodiment of the present invention, it is preferred that the vibration-permitting part is a soft gasket that is disposed between the edge portion of the diaphragm and the support member.

In one embodiment of the present invention, it is preferred that the vibration-permitting part is a space that is formed between the edge portion of the diaphragm and the support member.

To achieve the above object, present invention provides a glass sheet composite including a diaphragm that is vibrated by a vibrator, and a support in which the diaphragm includes at least one glass sheet, and is formed into a rectangular shape having edge portions in four sides thereof, so that the support member is attached to, of the edge portions of the four sides, edge portions of the other sides than at least one edge portion.

In one embodiment of the present invention, it is preferred that the diaphragm has a loss coefficient at 25° C. of $1\times10^{-2}$ or more and a longitudinal wave acoustic velocity in a sheet thickness direction of $5.0\times10^{3}$ m/s or more.

In one embodiment of the present invention, it is preferred that the diaphragm includes a plurality of glass sheets, and a liquid layer is provided between at least a pair of glass sheets out of the plurality of glass sheets.

Advantageous Effects of Invention

According to the present invention, it is possible to provide a glass sheet composite with excellent acoustic performance.

MODE FOR CARRYING OUT THE INVENTION

Figure 1:
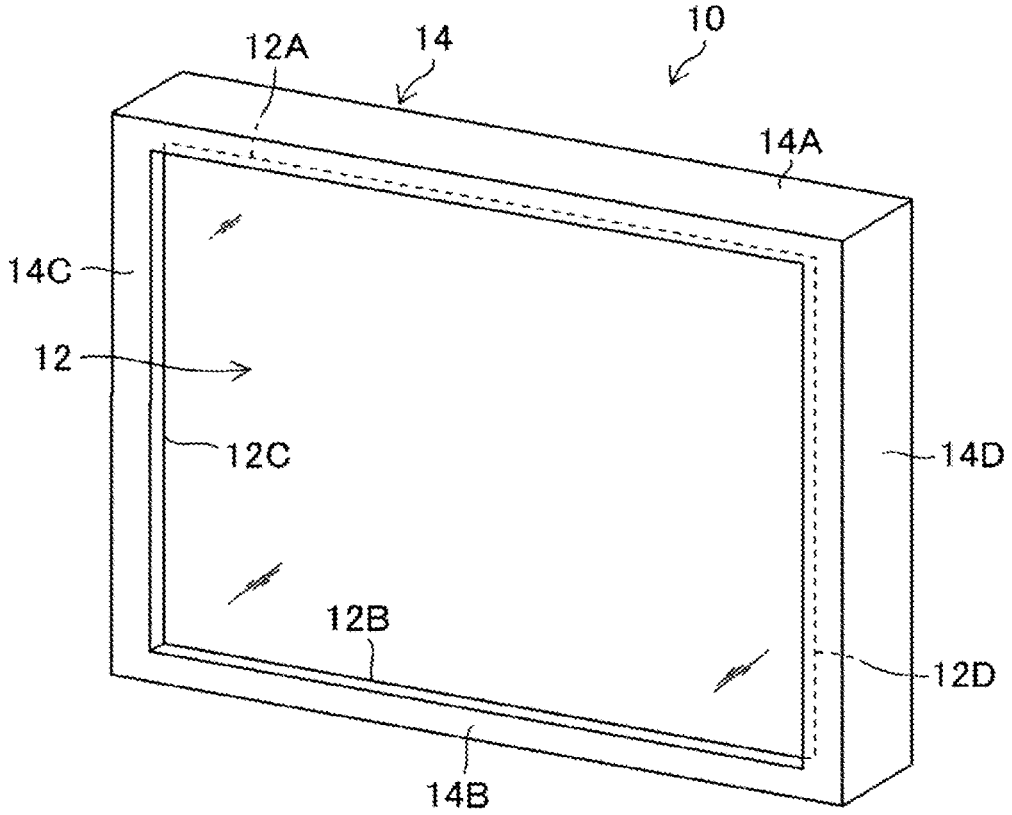
FIG. 1 is a perspective view of a glass sheet composite according to the first embodiment.

Preferred embodiments of a glass sheet composite according to the present invention will be described below with reference to the accompanying drawings. In the following drawings, the same or corresponding reference numeral is assigned to the same or corresponding members of parts, and duplicated description is thereby omitted.

In addition, "-" indicating a numerical range in the present description is used in the sense of including the numerical values set forth before and after "-" as the lower limit value and the upper limit value of the range, respectively.

FIG. 1 is a perspective view of a glass sheet composite 10 according to the first embodiment.

The glass sheet composite 10 has a diaphragm 12 which is vibrated by vibrators as will be described later, and a support member 14 which is attached to an edge portion of the diaphragm 12 to support the diaphragm 12.

The diaphragm 12 used in the present embodiment will be described before the features of the glass sheet composite 10 are described.

It is preferable that the diaphragm 12 has a loss coefficient at 25° C. of $1\times10^{-2}$ or more and a longitudinal wave acoustic velocity in the sheet thickness direction of $5.0\times10^{3}$ m/s or more. A high loss coefficient means that the vibration damping capability is high.

As for the loss coefficient, a value calculated by a half-width method is used. Denoting f as a peak top value of the resonant frequency of a material and W as a frequency width at a point −3 dB down from a peak value of amplitude h (namely, a point of maximum amplitude −3 [dB]), the loss coefficient is defined as a value represented by {W/f}.

In order to prevent the resonance, the loss coefficient of the diaphragm 12 may be increased. The increase in loss coefficient means that the frequency width W becomes relatively large with respect to the amplitude h and the peak becomes broader.

The loss coefficient is a value inherent in a material, etc. and, for example, in the case of a simplex glass sheet, the loss coefficient varies depending on its composition, relative density, etc. The loss coefficient can be determined by a dynamic modulus test such as a resonance frequency method.

The term "longitudinal wave acoustic velocity" means a velocity at which a longitudinal wave propagates in a diaphragm. The longitudinal wave acoustic velocity and the Young's modulus can be measured by the ultrasonic pulse method described in Japanese Industrial Standards (JIS-R1602-1995).

The diaphragm 12 in the glass sheet composite 10 has only to be provided with at least one glass sheet, that is, may be made of only one glass (simplex sheet). However, as a specific configuration for obtaining a high loss coefficient and a high longitudinal wave acoustic velocity, it is preferable to include two or more glass sheets and include a predetermined liquid layer between at least a pair of glass sheets out of the glass sheets.

The diaphragm 12 can realize a high loss coefficient by providing a liquid layer formed of a liquid between at least a pair of glass sheets. Particularly, when the viscosity and surface tension of the liquid layer are set within suitable ranges, the loss coefficient can be made higher.

This is considered to be attributed to the fact that, unlike the case of providing a pair of glass sheets with an adhesive layer therebetween, the pair of glass sheets are not fixed but can keep on exhibiting vibration characteristics in each individual glass sheet.

The liquid layer preferably has a viscosity coefficient at 25° C. of $1\times10^{-4}$ to $1\times10^{3}$ Pa·s and a surface tension at 25° C. of 15-80 mN/m. If the viscosity is too low, vibration can be hard to transmit, and if it is too high, a pair of glass sheets located on both sides of the liquid layer are fixed to each other and exhibit a vibration behavior as one glass sheet, making it difficult to damp resonant vibration. If the surface tension is too low, the adhesion between the glass sheets decreases, and vibration can be hard to transmit. If the surface tension is too high, the pair of glass sheets located on the both sides of the liquid layer are readily fixed to each other and exhibit a vibration behavior as one glass sheet and in turn, the resonant vibration is difficult to damp.

The viscosity coefficient at 25° C. of the liquid layer is more preferably $1\times10^{-3}$ Pa·s or more, still more preferably $1\times10^{-2}$ Pa·s or more. On the other hand, the viscosity coefficient is more preferably $1\times10^{2}$ Pa·s or less, still more preferably 1×10 Pa·s or less.

The surface tension at 25° C. of the liquid layer is more preferably 20 mN/m or more, still more preferably 30 mN/m or more.

The viscosity coefficient of the liquid layer can be measured by a rotational viscometer, etc. The surface tension of the liquid layer can be measured by a ring method, etc.

If the vapor pressure of the liquid layer is too high, the liquid layer may evaporate. Accordingly, the vapor pressure at 25° C. and 1 atm of the liquid layer is preferably $1\times10^{4}$ Pa or less, more preferably $5\times10^{3}$ Pa or less, still more preferably $1\times10^{3}$ Pa or less. To prevent the liquid layer from evaporating or flowing out, sealing, etc. with a sealing material may be applied. On this occasion, it is necessary to prevent the sealing material from hindering the vibration of the diaphragm 12. Examples of the sealing material may include a polyvinyl acetate-based material, a polyvinyl chloride-based material, a polyvinyl alcohol-based material, an ethylene copolymer-based material, a polyacrylic ester-based material, a cyanoacrylate-based material, a saturated polyester-based material, a polyamide-based material, a linear polyimide-based material, a melamine resin, an urea resin, a phenolic resin, an epoxy-based material, a polyurethane-based material, an unsaturated polyester-based material, a reactive acrylic-based material, a rubber-based material, a silicone-based material, a modified silicone-based material, etc.

In view of high rigidity maintenance and vibration transfer, it is more preferable that the liquid layer has a smaller thickness. Specifically, when the total thickness of the pair of glass sheets is 1 mm or less, the thickness of the liquid layer is preferably 1/10 or less, more preferably 1/20 or less, still more preferably 1/30 or less, yet still more preferably 1/50 or less, even still more preferably 1/70 or less, even yet still more preferably 1/100 or less, of the total thickness of the pair of glass sheets.

In the case where the total thickness of the pair of glass sheets is more than 1 mm, the thickness of the liquid layer is preferably 100 μm or less, more preferably 50 μm or less, still more preferably 30 μm or less, yet still more preferably 20 μm or less, even still more preferably 15 μm or less, even yet still more preferably 10 μm or less. The lower limit of the thickness of the liquid layer is preferably 0.01 μm or more in view of film-forming property and durability.

It is preferred that the liquid layer is chemically stable and a reaction does not occur between the liquid layer and the pair of glass sheets located on the both sides of the liquid layer. The "chemically stable" means, for example, to undergo less degradation (deterioration) by light irradiation or not to cause solidification, vaporization, decomposition, discoloration, chemical reaction with glass, etc. at least in a temperature region of −20 to 70° C.

The liquid layer may include, specifically as its component, water, oil, an organic solvent, a liquid polymer, an ionic liquid, a mixture thereof, etc.

More specifically, the component may include propylene glycol, dipropylene glycol, tripropylene glycol, straight silicone oil (dimethyl silicone oil, methyl phenyl silicone oil, and methyl hydrogen silicone oil), modified silicone oil, an acrylic acid-based polymer, liquid polybutadiene, glycerin paste, a fluorine-based solvent, a fluororesin, acetone, ethanol, xylene, toluene, water, mineral oil, and a mixture thereof. Among those, it is preferable to contain at least one member selected from the group consisting of propylene glycol, dimethyl silicone oil, methyl phenyl silicone oil, methyl hydrogen silicone oil, and modified silicone oil, and it is more preferable to contain propylene glycol or silicone oil as a main component.

In addition to the aforementioned components, a slurry having a powder dispersed therein may be also used as the liquid layer. From the viewpoint of enhancing the loss coefficient, the liquid layer is preferably a uniform fluid, but in the case of imparting design or functionality such as coloration or fluorescence to the glass sheet composite, the slurry is effective.

The content of the powder in the liquid layer is preferably from 0-10 vol %, more preferably from 0-5 vol %. From the viewpoint of preventing sedimentation, the particle diameter of the powder is preferably from 10 nm to 1 more preferably 0.5 μm or less.

In addition, from the viewpoint of imparting design and functionality, the liquid layer may contain a fluorescent material. The liquid layer may be either a slurry-like liquid layer in which a fluorescent material is dispersed as a powder, or a uniform liquid layer in which a fluorescent material is mixed as a liquid. Because of this configuration, an optical function such as light absorption or light emission can be imparted to the glass sheet composite.

Figure 2:
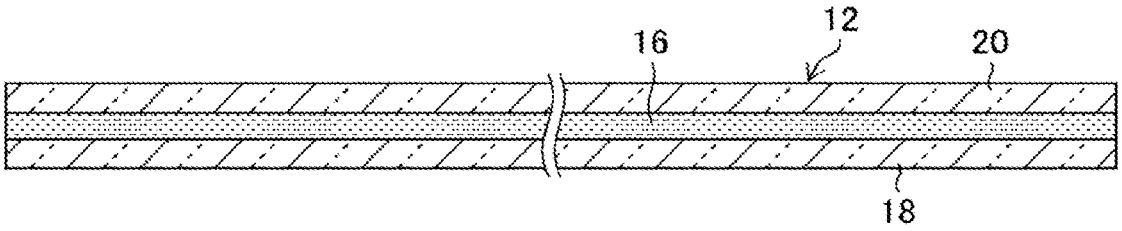
FIG. 2 is a sectional view of a diaphragm of the glass sheet composite shown in FIG. 1.

FIG. 2 is a sectional view of the diaphragm 12 according to the present embodiment.

The diaphragm 12 according to the embodiment has a pair of glass sheets 18 and 20 holding the liquid layer 16 from its opposite sides. When the glass sheet 18 which is one of the glass sheets resonates in the diaphragm 12 thus configured, the presence of the liquid layer 16 can prevent the other glass sheet 20 from resonating or can damp resonant vibration of the glass sheet 20, so that the loss coefficient can be made higher than in a case where the diaphragm 12 is made of a simplex sheet.

The peak top value of resonant frequency of the glass sheet 18 which is one of the glass sheets preferably differs from that of the other glass sheet 20, and it is more preferable that the ranges of the resonant frequencies of the two glass sheets do not overlap each other. However, even when the ranges of the resonant frequencies of the glass sheet 18 and the glass sheet 20 overlap each other or the peak top values of the two glass sheets are the same as each other, resonance of the glass sheet 18 which is one of the glass sheets does not lead to synchronized vibration in the other glass sheet 20 due to the presence of the liquid layer 16 but the resonances of the two glass sheets can be canceled with each other to some extent. Accordingly, a high loss coefficient can be obtained as compared with the case where the diaphragm 12 is made of a simplex sheet.

Denoting Qa as the peak top value of the resonant frequency of the glass sheet 18, wa as the half-width of resonance amplitude of the glass sheet 18, Qb as the peak top value of the resonant frequency of the other glass sheet 20, and wb as the half-width of resonance amplitude of the glass sheet 20, it is preferable to satisfy the relationship of the following [equation 1]:

$$(wa+wb)/4<|Qa-Qb| \quad \text{[equation 1]}$$

The larger the value on the left side in [formula 1] is, the larger the difference (|Qa−Qb|) in the peak top value of the resonant frequency between the glass sheet 18 and the glass sheet 20 becomes, and a higher loss coefficient is advantageously obtained, and it is hence preferred. Accordingly, it is more preferable to satisfy the following [formula 1'], and it is still more preferable to satisfy the following [formula 1"]:

$$(wa+wb)/2<|Qa-Qb| \quad \text{[equation 1']}$$

$$(wa+wb)/1<|Qa-Qb| \quad \text{[equation 1"]}$$

The peak top value of the resonant frequency of each glass sheet and the half-width of the resonance amplitude of the same can be measured by the same method as that for the loss coefficient.

The mass difference between the glass sheet 18 and the glass sheet 20 is preferably smaller, and it is more preferred that there is no mass difference. If there is a mass difference, resonation of a lighter glass sheet can be reduced by a heavier glass sheet, but resonation of the heavier glass sheet can be hardly reduced by the lighter glass sheet. This is because if the mass ratio is imbalance, in principle resonant vibrations cannot be mutually canceled due to the difference in inertial force.

The mass ratio of the glass sheet 18 to the glass sheet 20 (mass of glass sheet 18/mass of glass sheet 20) is preferably 0.8-1.25 (from 8/10 to 10/8), more preferably 0.9-1.1 (from 9/10 to 10/9), still more preferably 1.0 (10/10, mass difference of 0).

As the thickness of each of the glass sheet 18 and the glass sheet 20 is smaller, the glass sheets 18 and 20 can adhere to each other more easily via a liquid layer, and the glass sheets 18 and 20 can be vibrated with less energy. Accordingly, as for the thickness of each glass sheet 18, 20 for use in diaphragm applications as in loudspeakers etc., the smaller, the better. Specifically, the thickness of each of the glass sheet 18 and the glass sheet 20 is preferably 15 mm or less, more preferably 10 mm or less, still more preferably 5 mm or less, yet still more preferably 3 mm or less, even still more preferably 1.5 mm or less, even yet still more preferably 0.8 mm or less. On the other hand, if the thickness of each glass sheet is too small, effects of surface defects of the glass sheet are likely to be revealed, and cracking occurs more easily, or a strengthening treatment is difficult to apply. For this reason, the thickness is preferably 0.01 mm or more, more preferably 0.05 mm or more.

In addition, in the application as an opening member for buildings and vehicles, which reduces occurrence of an abnormal noise attributed to a resonance phenomenon, the thickness of each of the glass sheet 18 and the glass sheet 20 is preferably 0.5-15 mm, more preferably 0.8-10 mm, still more preferably from 1.0-8 mm.

In the application as a diaphragm, it is preferable that at least one of the glass sheet 18 and the glass sheet 20 has a high loss coefficient so as to increase vibration damping as the diaphragm 12. Specifically, the loss coefficient at 25° C. of the glass sheet is preferably $1\times10^{-4}$ or more, more preferably $3\times10^{-4}$ or more, still more preferably $5\times10^{-4}$ or more. The upper limit is not particularly limited but is preferably $5\times10^{-3}$ or less in view of productivity and manufacturing cost. It is more preferred that both the glass sheet 18 and the glass sheet 20 have the above-described loss coefficient.

In the application as a diaphragm, it is preferable that at least one of the glass sheet 18 and the glass sheet 20 has a high longitudinal wave acoustic velocity in the sheet thickness direction so as to enhance the sound reproducibility in a high-frequency region. Specifically, the longitudinal wave acoustic velocity of the glass sheet is preferably $5.0\times10^3$ m/s or more, more preferably $5.5\times10^3$ m/s or more, still more preferably $6.0\times10^3$ m/s or more. The upper limit is not particularly limited but is preferably $7.0\times10^3$ m/s or less in view of the productivity and the raw material cost. It is more preferred that both the glass sheet 18 and the glass sheet 20 satisfy the above-described acoustic velocity.

The longitudinal wave acoustic velocity of the glass sheet can be measured by the same method as that for the longitudinal wave acoustic velocity of the glass sheet composite.

The composition of each of the glass sheet 18 and the glass sheet 20 is not particularly limited but preferably contains components, for example, in the following ranges:

$SiO_2$: 40-80 mass %, $Al_2O_3$: 0-35 mass %, $B_2O_3$: 0-15 mass %, MgO: 0-20 mass %, CaO: 0-20 mass %, SrO: 0-20 mass %, BaO: 0-20 mass %, $Li_2O$: 0-20 mass %, $Na_2O$: 0-25 mass %, $K_2O$: 0-20 mass %, $TiO_2$: 0-10 mass %, and $ZrO_2$: 0-10 mass %, provided that the composition above accounts for 95 mass % or more of the entire glass.

The composition of each of the glass sheet 18 and the glass sheet 20 contains components more preferably in the following ranges:

$SiO_2$: 55-75 mass %, $Al_2O_3$: 0-25 mass %, $B_2O_3$: 0-12 mass %, MgO: 0-20 mass %, CaO: 0-20 mass %, SrO: 0-20 mass %, BaO: 0-20 mass %, $Li_2O$: 0-20 mass %, $Na_2O$: 0-25 mass %, $K_2O$: 0-15 mass %, $TiO_2$: 0-5 mass %, and $ZrO_2$: 0-5 mass %, provided that the composition above accounts for 95 mass % or more of the entire glass.

In addition, each of the glass sheet 18 and the glass sheet 20 may be of an organic glass.

It is preferable for each of the glass sheet 18 and the glass sheet 20 to have smaller specific gravity so that the glass sheet can be vibrated with less energy. Specifically, the specific gravity of each of the glass sheet 18 and the glass sheet 20 is preferably 2.8 or less, more preferably 2.6 or less, still more preferably 2.5 or less. The lower limit is not particularly limited but is preferably 2.2 or more.

When the specific elastic modulus, which is a value obtained by dividing the Young's modulus of each of the glass sheet 18 and the glass sheet 20 by the density thereof, is larger, the rigidity of the glass sheet can be increased. Specifically, the specific elastic modulus of each of the glass sheet 18 and the glass sheet 20 is preferably $2.5\times10^7$ $m^2/s^2$ or more, more preferably $2.8\times10^7$ $m^2/s^2$ or more, still more preferably $3.0\times10^7$ $m^2/s^2$ or more. The upper limit is not particularly limited but is preferably $4.0\times10^7$ $m^2/s^2$ or less.

At least one of the glass sheet 18, the glass sheet 20 and the liquid layer 16 can be also colored. This is useful in the case where the diaphragm 12 is expected to have design or to have functionality such as IR cut, UV cut or privacy glass.

When the diaphragm 12 has a configuration in which a liquid layer is included between glass sheets, the glass sheets constituting the diaphragm 12 have only to be two or more, but three or more glass sheets may be also used. The glass sheets constituting the diaphragm 12 may be glass sheets whose compositions are all different, may be glass sheets whose compositions are all the same, or may be a combination of glass sheets having the same composition and a glass sheet having a different composition. Particularly, two or more kinds of glass sheets differing in composition are preferably used in view of vibration damping.

Similarly, as to the mass and thickness of the plurality of glass sheets constituting the diaphragm 12, the glass sheets may be all different or all the same, or some of them may be different. Above all, in view of vibration damping, all of the constituent glass sheets preferably have the same mass.

A physically strengthened glass sheet or a chemically strengthened glass sheet may be also used as at least one of the glass sheets constituting the diaphragm 12. This is useful in preventing the diaphragm 12 from being broken. When an increase in the strength of the diaphragm 12 is desired, the physically strengthened glass sheet or the chemically strengthened glass sheet is preferably used for the glass sheet located on the outermost surface of the diaphragm 12. It is more preferred that all the constituent glass sheets are physically strengthened glass sheets or chemically strengthened glass sheets.

In addition, from the viewpoint of increasing the longitudinal wave acoustic velocity or the strength, it is also useful to use crystallized glass or phase-separated glass as each glass sheet. Particularly when an increase in the strength of the diaphragm 12 is desired, it is preferred to use crystallized glass or phase-separated glass as the glass sheet located on the outermost surface of the diaphragm 12.

On at least one outermost surface of the diaphragm 12, a coating or a film may be applied or attached as long as the acoustic effects are not impaired. The application of the coating or the attachment of the film is suitable for scratch protection, etc.

It is preferred that the thickness of the coating or the film is ⅕ or less of the sheet thickness of the glass sheet of the surface layer. A conventionally known material can be used for the coating or the film. Examples of the coating may include a water-repellent coating, a hydrophilic coating, a water sliding coating, an oil-repellent coating, a light reflection preventive coating, and a heat shielding coating. Examples of the film may include a glass anti-shatter film, a color film, a UV cut film, an IR cut film, a heat-shielding film, and an electromagnetic wave shielding film.

The shape of the diaphragm 12 can be appropriately designed according to applications and may be a flat plate-like shape or a curved surface shape.

In order to raise the output sound pressure level in a low-frequency range, the diaphragm 12 may be made to have a structure including an enclosure or a baffle plate.

Return to FIG. 1 to make description about the glass sheet composite 10 according to the first embodiment.

First, the object of the present invention is to provide the glass sheet composite 10 in which the diaphragm 12 is effectively supported on the support member 14 without impairing the acoustic performance intrinsic to the diaphragm 12 itself. As described previously, in a conventional glass sheet composite, all the peripheral edge portions of the four sides of a diaphragm are supported on a frame body (support member) through a mediation layer. That is, all the peripheral portions of the four sides of the diaphragm are bound to the support member through a mediation layer. Accordingly, vibration of the diaphragm by vibrators is transmitted from all the peripheral edge portions of the four sides of the diaphragm to the support member so that sound is also generated from the support member. Thus, it is not possible to obtain excellent acoustic performance.

In the present invention, therefore, it is focused on that vibration transmitted from the diaphragm to the support member can be reduced by improving a support structure (corresponding to the mediation layer in the background art) by which a diaphragm is supported on a support member. The present invention provides a glass sheet composite provided with such a support structure.

The glass sheet composite provided with the support structure according to the present invention has the following fundamental structure.

That is, the glass sheet composite according to the present invention includes a diaphragm that is vibrated by a vibrator, and a support member that is attached along an edge portion of the diaphragm so as to support the diaphragm, in which the diaphragm includes at least one glass sheet, and the diaphragm is supported on the support member through a fixing part that fixes the edge portion of the diaphragm to the support member, and a vibration-permitting part that permits vibration of the diaphragm.

In the glass sheet composite according to the present invention, all the peripheral portion of the diaphragm is not attached to the support member through the fixing part, but is attached to the support member through a support structure constituted by the fixing part and the vibration-permitting part. That is, it is possible to form a glass sheet composite in which the edge portion of the diaphragm is attached to the support member through the fixing part so that the diaphragm is effectively supported on the support member. Vibration of the diaphragm is permitted by the vibration-permitting part so that the vibration of the diaphragm can be prevented or reduced from being transmitted from the vibration-permitting part to the support member.

Accordingly, in the glass sheet composite according to the present invention, vibration transmitted from the diaphragm to the support member can be reduced as compared with that in the glass sheet composite in the background art. Thus, in the glass sheet composite according to the present invention, sound generated in the support member can be reduced so that excellent acoustic performance can be obtained.

The vibration-permitting part mentioned herein is a part which does not fix the diaphragm to the support member but permits vibration of the diaphragm so that the vibration of the diaphragm is reduced or prevented from being transmitted to the support member. Examples of the form of the vibration-permitting part may include a soft backer or a soft gasket that is disposed between the edge portion of the diaphragm and the support member, or a space formed between the edge portion of the diaphragm and the support member. This point will be described later.

A specific structure of the glass sheet composite 10 according to the first embodiment will be described below.

The glass sheet composite 10 according to the first embodiment is a glass sheet composite having a form in which the edge portions of the four sides of the diaphragm 12 are supported on the support member 14, and which is suitable particularly for a window.

The diaphragm 12 is formed into a rectangular shape including an edge portion (hereinafter also referred to as an upper edge portion) 12A, an edge portion (hereinafter also referred to as a lower edge portion) 12B, an edge portion (hereinafter also referred to as a left edge portion) 12C and an edge portion (hereinafter also referred to as a right edge portion) 12D of the four sides. The support member 14 is formed into a frame-like body so that the support member 14 can be attached along the edge portions 12A to 12D of the four sides of the diaphragm 12. That is, the support member 14 includes a frame (hereinafter also referred to as an upper frame) 14A attached along the upper edge portion 12A of the diaphragm 12, a frame (hereinafter also referred to as a lower frame) 14B attached along the lower edge portion 12B, a frame (hereinafter also referred to as a left frame) 14C attached along the left edge portion 12C, and a frame (hereinafter also referred to as a right frame) 14D attached along the right edge portion 12D.

As the material of the support member 14, metal or an alloy material such as steel, iron, stainless steel, aluminum, titanium, magnesium, or tungsten carbide, a composite material such as FRP, a resin material such as acryl or polycarbonate, a glass material, wood or the like may be used. The material of the support member 14 is not particularly limited.

Figure 3:
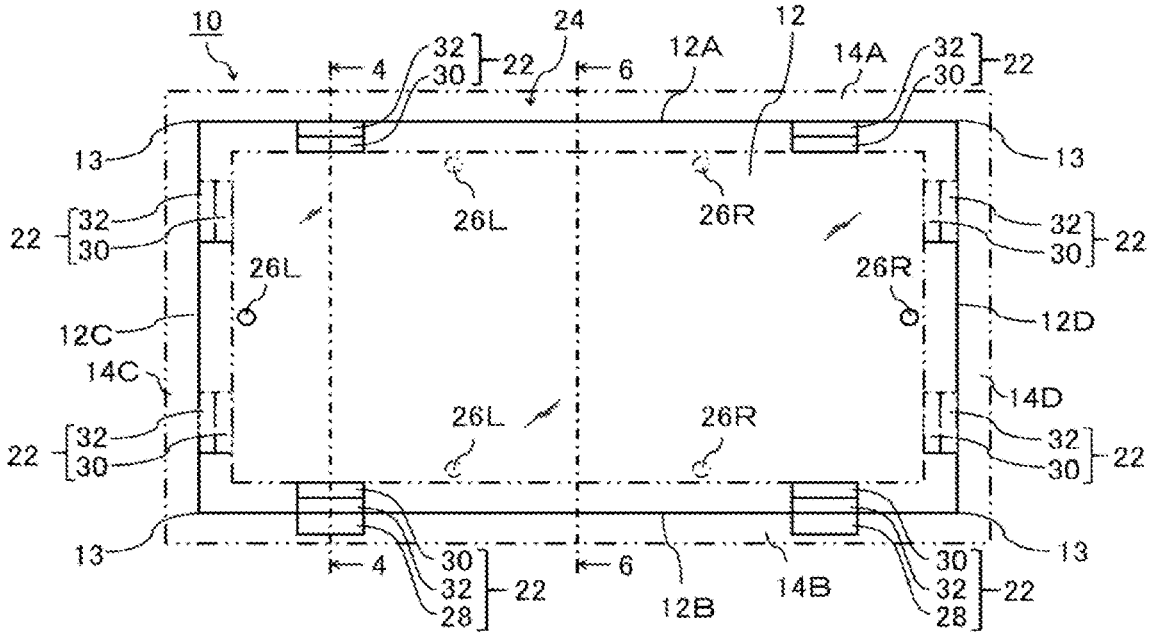
FIG. 3 is a plan view of the glass sheet composite illustrating positions where fixing parts and vibration-permitting parts are disposed by way of example.

FIG. 3 is a plan view of the glass sheet composite 10 in which the support member 14 of the glass sheet composite 10 is seen through and positions where fixing parts 22 and vibration-permitting parts 24 are disposed are illustrated by way of example.

As shown in FIG. 3, the fixing parts 22 are disposed intermittently along the upper edge portion 12A and the lower edge portion 12B of the diaphragm 12. For example, in the upper edge portion 12A, two fixing parts 22 are disposed in positions close to left and right corner portions 13 of the upper edge portion 12A, and similarly in the lower edge portion 12B, two fixing parts 22 are disposed in positions close to left and right corner portions 13 of the lower edge portion 12B. Disposing the fixing parts 22 in such positions enables to attach a left vibrator 26L to the vicinity of the central position of the left edge portion 12C, and to attach a right vibrator 26R to the vicinity of the central position of the right edge portion 12D, and thus the glass sheet composite 10 can be formed as a stereo type.

Note that FIG. 3 illustrates the arrangement positions of the fixing parts 22 by way of example, and the arrangement positions are not limited to those in FIG. 3. For example, the fixing parts 22 may be disposed intermittently along the left edge portion 12C and the right edge portion 12D of the diaphragm 12 as shown by the alternate long and two short dashes line in FIG. 3. Also in this case, it is preferred that in the left edge portion 12C, two fixing parts 22 are disposed in positions close to upper and lower corner portions 13 of the left edge portion 12C, and similarly in the right edge portion 12D, two fixing parts 22 are disposed in positions close to upper and lower corner portions 13 of the right edge portion 12D. Disposing the fixing parts 22 in such positions enables to attach the left vibrator 26L and the right vibrator 26R to the vicinities of the central positions of the upper edge portion 12A and the lower edge portion 12B respectively, and thus the glass sheet composite 10 can be formed as a stereo type.

Figure 4:
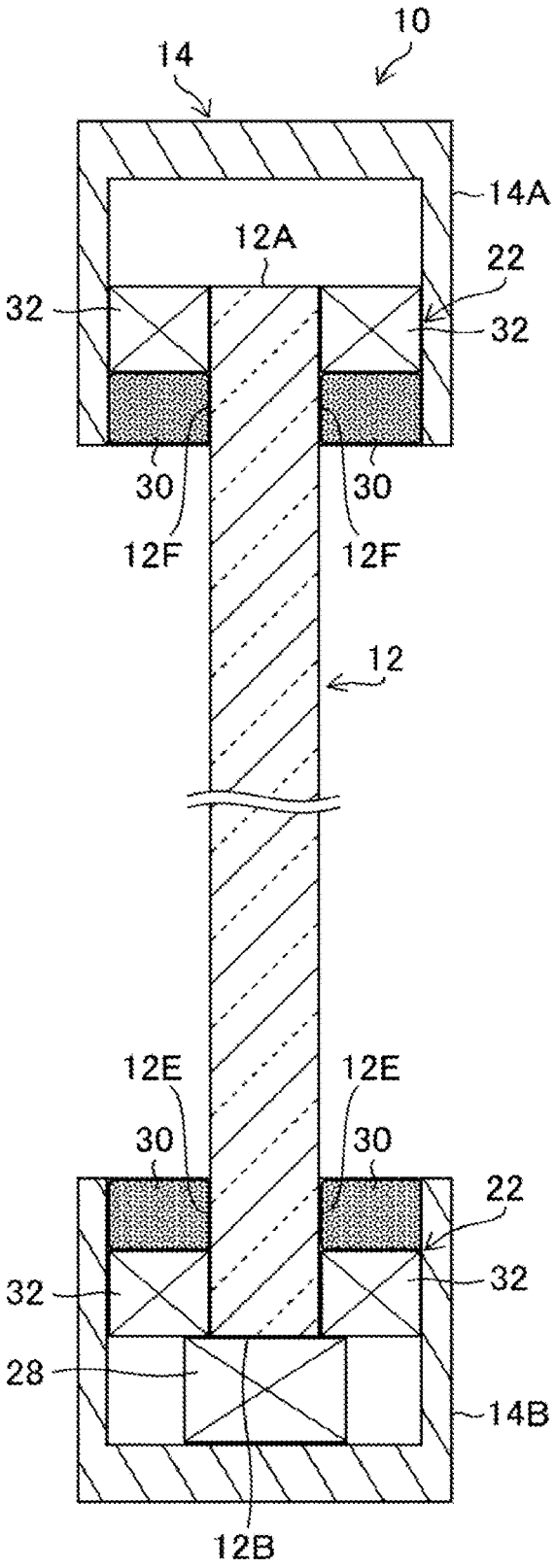
FIG. 4 is a sectional view of the glass sheet composite illustrating the first example of the fixing parts.

FIG. 4 is a sectional view of the glass sheet composite 10 taken on line 4-4 in FIG. 3, showing a section of the glass sheet composite 10 illustrating a first example of the fixing parts 22.

As shown in FIG. 4, the fixing part 22 by which the lower edge portion 12B of the diaphragm 12 is attached to the lower frame 14B of the support member 14 includes a setting block 28 on which the lower edge portion 12B of the diaphragm 12 is mounted, and a seal material 30 by which the lower edge portion 12B of the diaphragm 12 is fixed to the lower frame 14B.

The lower frame 14B (similar to the upper frame 14A, the left frame 14C and the right frame 14D) of the support member 14 is formed to have a U-shape in section, which can receive the lower edge portion 12B of the diaphragm 12 and lower-side portions 12E and 12E of front and back surfaces (also referred to as main surfaces) of the diaphragm 12 continuously connected to the lower edge portion 12B. The setting block 28 is mounted on a bottom portion of the lower frame 14B, and the seal material 30 is charged into the lower frame 14B to seal the lower-side portions 12E and 12E. In addition, if necessary, blocks 32 and 32 made of hard rubber and receiving a force in an out-of-plane direction of the diaphragm 12 are fitted into the lower frame 14B so as to hold the lower-side portions 12E and 12E therebetween. In the present description, each edge portion is defined as a portion including the substantial edge portion 12A to 12D, upper, lower, left and right side portions of the front and back surfaces continuous and adjacent to the edge portion 12A to 12D.

On the other hand, the fixing part 22 by which the upper edge portion 12A of the diaphragm 12 is attached to the upper frame 14A of the support member 14 is provided with a seal material 30. This seal material 30 is charged into the upper frame 14A so as to seal upper-side portions 12F and 12F of the diaphragm 12. In addition, if necessary, blocks 32 and 32 are fitted into the upper frame 14A so as to hold the upper-side portions 12F and 12F therebetween.

According to the fixing parts 22 thus configured, the diaphragm 12 can be firmly attached to the upper frame 14A and the lower frame 14B through the seal materials 30 while the weight of the diaphragm 12 itself is received by the setting block 28.

As to the blocks 32 made of hard rubber, chloroprene rubber, EPDM rubber, silicone rubber, etc. can be used.

As to the setting block 28, chloroprene rubber, EPDM rubber, silicone rubber, etc. can be used.

In addition, as to the seal materials 30, a polyvinyl acetate-based resin, a polyvinyl chloride-based resin, a polyvinyl alcohol-based resin, an ethylene copolymer-based resin, a polyacrylate ester-based resin, a cyanoacrylate-based resin, a saturated polyester-based resin, a polyamide-based resin, a linear polyimide-based resin, a melamine resin, an urea resin, a phenolic resin, an epoxy-based resin, a polyurethane-based resin, an unsaturated polyester-based resin, a reactive acyl-based resin, a rubber-based resin, a silicone-based resin, a modified silicone-based resin, etc. can be used.

Figure 5:
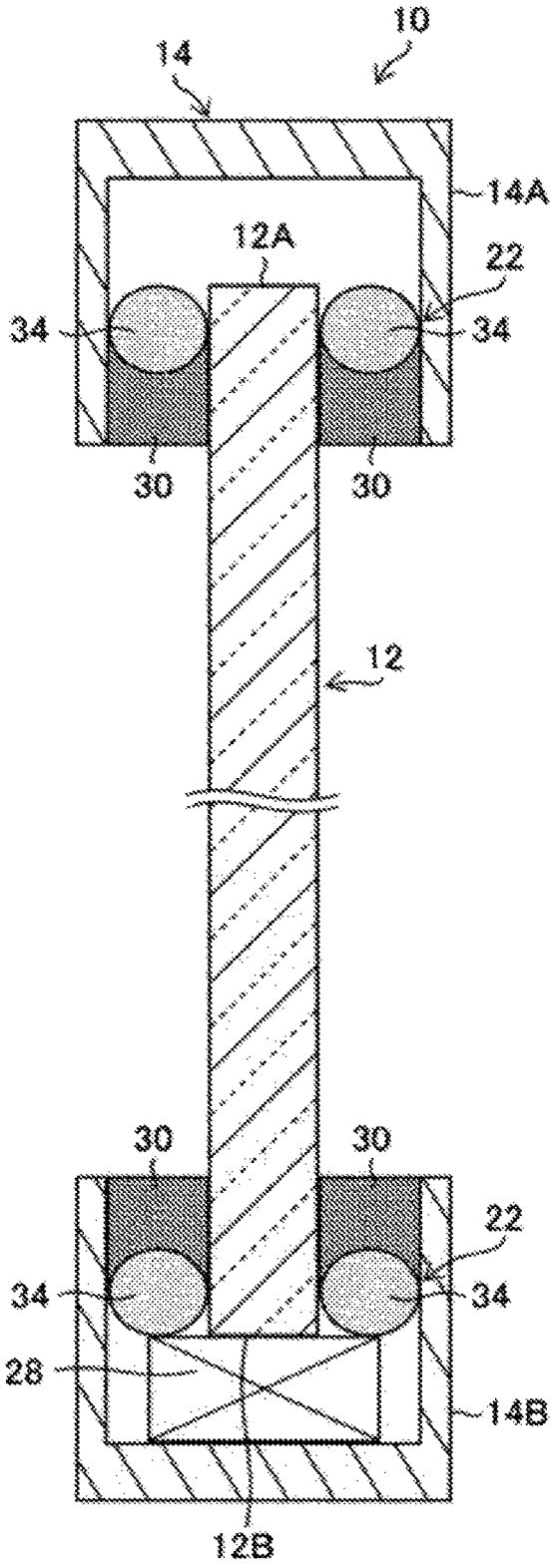
FIG. 5 is a sectional view of the glass sheet composite illustrating the second example of the fixing parts.

FIG. 5 is a sectional view of the glass sheet composite 10 illustrating the second example of the fixing parts 22. In the fixing parts 22 in FIG. 5, the blocks 32 in the first example shown in FIG. 4 are replaced by backers 34.

The diaphragm 12 can be firmly attached to the upper frame 14A and the lower frame 14B even by the fixing parts 22 shown in FIG. 5.

As to the backers 34, foamed polyethylene, foamed chloroprene rubber, foamed urethane, EPDM rubber, etc. can be used.

Figure 6:
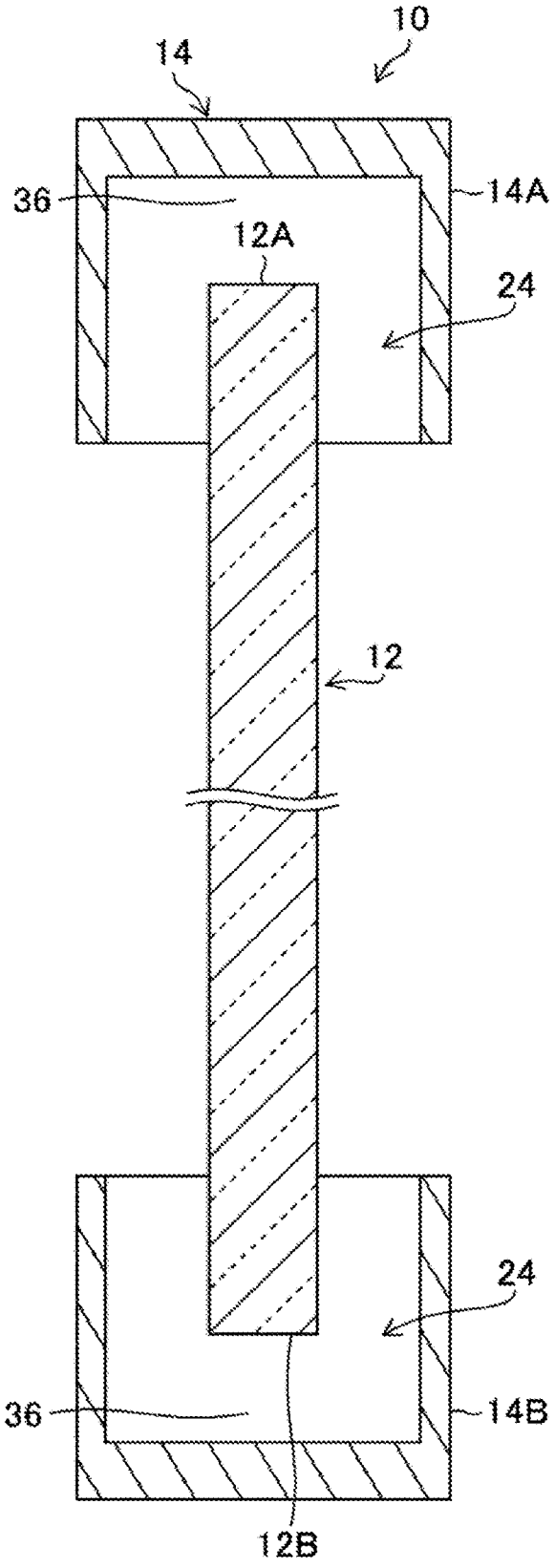
FIG. 6 is a sectional view of the glass sheet composite illustrating the first example of the vibration-permitting parts.

FIG. 6 is a sectional view of the glass sheet composite 10 taken on line 6-6 in FIG. 3, illustrating a section of the glass sheet composite 10 showing the first example of the vibration-permitting parts 24.

The vibration-permitting parts 24 in FIG. 6 are spaces 36 formed between the edge portions 12A to 12D of the diaphragm 12 and the support member 14. Making the vibration-permitting parts 24 into the spaces 36 enables to block vibration of the diaphragm 12 which is transmitted to the support member 14 through the spaces 36.

The spaces 36 may be filled with a soft filler such as closed-cell sponge. When the spaces 36 are filled with the soft filler, vibration of the diaphragm 12 is hardly transmitted from the vibration-permitting parts 24 to the support member 14, and airtightness in the glass sheet composite 10 can be secured. In addition, the filler has preferably a JIS-A hardness of 30 or less. The JIS-A hardness mentioned herein is based on a value measured by a durometer. That is, an indenter (press needle) is pressed into a measurement target to deform the measurement target, and the amount of deformation (indentation depth) is measured. An average value of the amounts of deformation thus measured at four or more locations is regarded as the JIS-A hardness. The area where the fixing parts 22 are disposed in the edge portions 12A to 12D of the diaphragm 12 is preferably smaller than the area where the vibration-permitting parts 24 occupy the edge portions 12A to 12D. When the area where the fixing parts 22 are disposed is smaller than the area occupied by the vibration-permitting parts 24, the glass sheet composite 10 has excellent acoustic performance.

Figure 7:
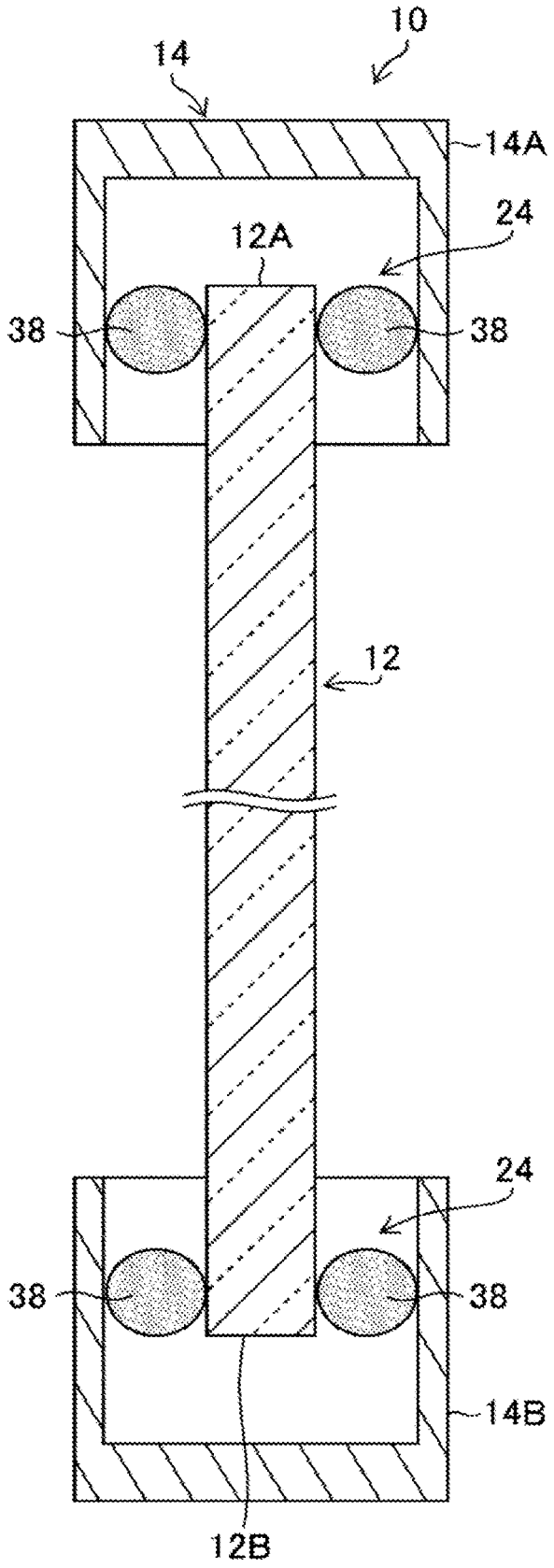
FIG. 7 is a sectional view of the glass sheet composite illustrating the second example of the vibration-permitting parts.

FIG. 7 is a sectional view of the glass sheet composite 10 illustrating the second example of the vibration-permitting parts 24. The vibration-permitting parts 24 in FIG. 7 are soft and stringy backers 38 which are disposed between the edge portions 12A to 12D of the diaphragm 12 and the support member 14. Using the soft backers 38 as the vibration-permitting parts 24 enables to reduce vibration transmitted from the diaphragm 12 to the support member 14 through the backers 38.

As the backers 38, foamed polyethylene or the like can be used. The backers 38 have preferably a rubber hardness of 20-50 degrees measured according to JIS K6253 (2012). When the rubber hardness of the backers 38 is 20-50 degrees, vibration transmitted from the diaphragm 12 to the support member 14 through the backers 38 can be sufficiently reduced. Making the foaming density of the foamed polyethylene or the like used as the backers 38 larger enables to reduce the rubber hardness of the backers 38.

Figure 8:
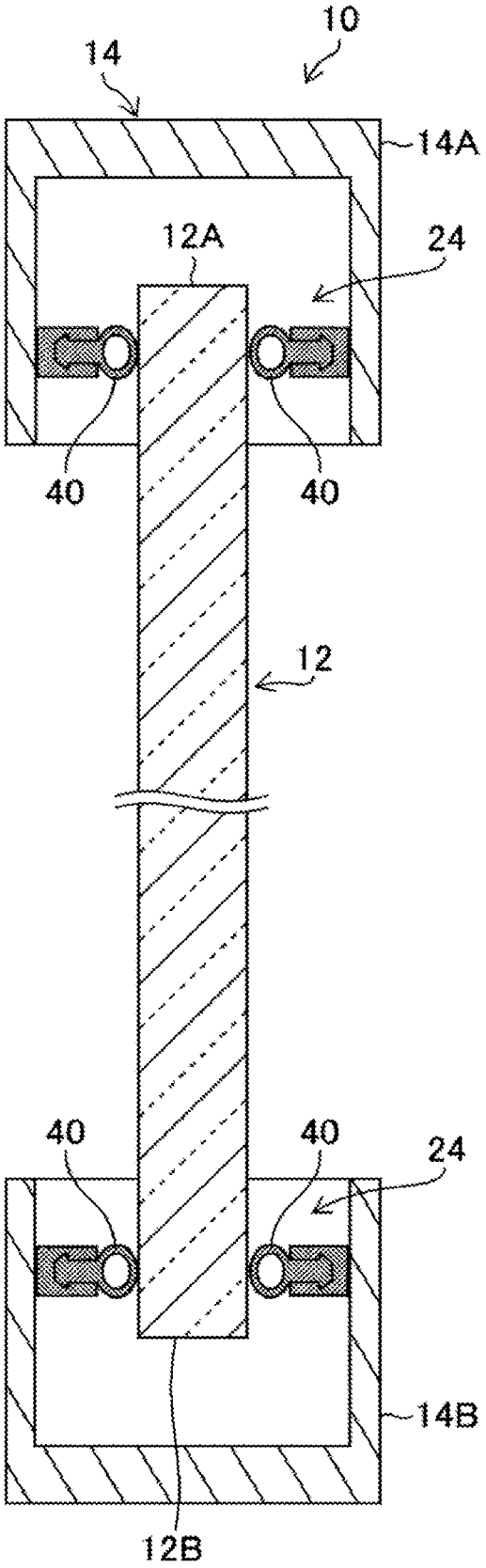
FIG. 8 is a sectional view of the glass sheet composite illustrating the third example of the vibration-permitting parts.

FIG. 8 is a sectional view of the glass sheet composite 10 illustrating the third example of the vibration-permitting parts 24. The vibration-permitting parts 24 in FIG. 8 are soft and stringy hollow gaskets 40 which are disposed between the edge portions 12A to 12D of the diaphragm 12 and the support member 14. Using the soft hollow gaskets 40 as the vibration-permitting parts 24 enables to reduce vibration transmitted from the diaphragm 12 to the support member 14 through the hollow gaskets 40. The gaskets are not limited to the hollow gaskets 40.

For the hollow gaskets 40, silicone sponge, silicone rubber, EPDM rubber, chloroprene rubber or the like can be used. The hollow gaskets 40 have preferably a rubber hardness of 20-70 degrees measured according to JIS K6253 (2012). When the rubber hardness of the hollow gaskets 40 is 20-70 degrees, vibration transmitted from the diaphragm 12 to the support member 14 through the hollow gaskets 40 can be sufficiently reduced.

As has been described above, the glass sheet composite 10 according to the first embodiment has excellent acoustic performance because the diaphragm 12 is supported on the support member 14 through the fixing parts 22 and the vibration-permitting parts 24.

Figure 9:
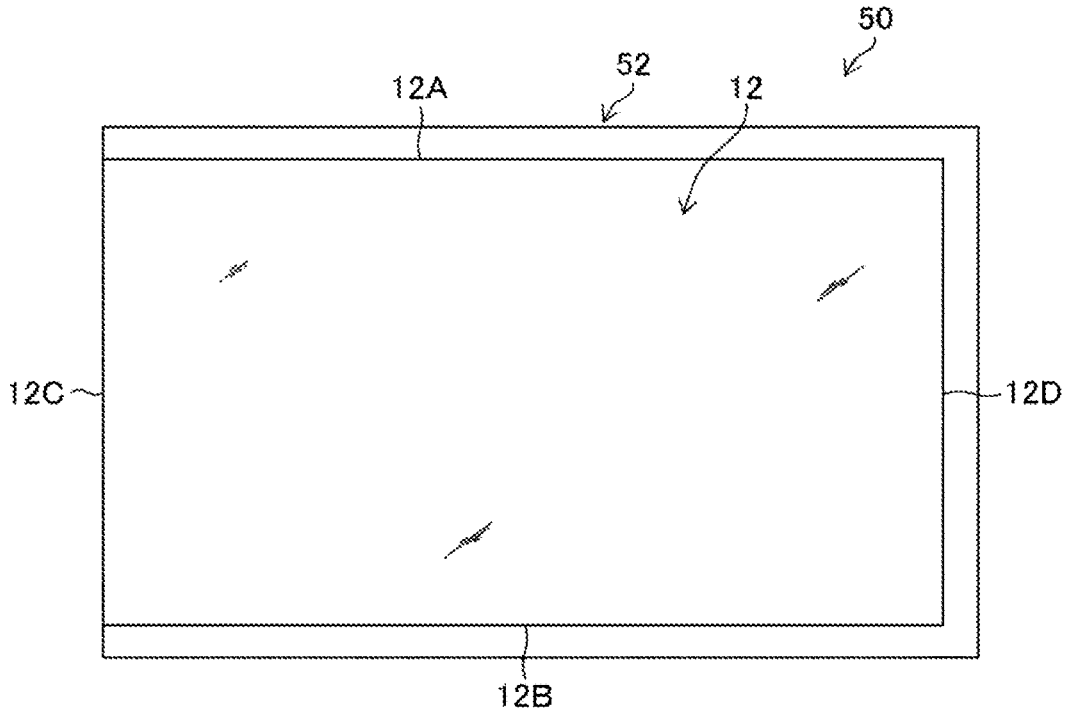
FIG. 9 is a plan view of a glass sheet composite according to the second embodiment.

FIG. 9 is a plan view of a glass sheet composite 50 according to the second embodiment.

The glass sheet composite 50 according to the second embodiment has a diaphragm 12 that is vibrated by vibrators, and a support member 52 that is attached to an edge portion of the diaphragm 12 to support the diaphragm 12. The diaphragm 12 has at least one glass sheet, and is formed into a rectangular shape having edge portions 12A to 12D of the four sides. In addition, a support member 52 having substantially a U-shape in planar view is attached to some edge portions (for example, the upper edge portion 12A, the lower edge portion 12B and the right edge portion 12D) of the edge portions 12A to 12D of the four sides except at least one edge portion (for example, the left edge portion 12C).

The glass sheet composite 50 according to the second embodiment has a configuration in which the left edge portion 12C is not supported on the support member 52 so that vibration of the left edge portion 12C is not transmitted to the support member 52. The glass sheet composite 50 according to the second embodiment thus configured also has excellent acoustic performance because vibration transmitted from the diaphragm 12 to the support member 52 can be reduced as compared with that in the conventional glass sheet composite.

In the glass sheet composite 50 according to the second embodiment, the support structure between the diaphragm 12 and the support member 52 is not limited. For example, the diaphragm 12 may be attached through a seal material, or may be attached through the fixing parts 22 shown in FIG. 4 and FIG. 5 and the vibration-permitting parts 24 shown in FIG. 6 to FIG. 8. In this manner, vibration transmitted from the diaphragm 12 to the support member 52 can be further reduced.

Although the support member 52 having substantially a U-shape in planar view is illustrated in the glass sheet composite 50 according to the second embodiment, the support member is not limited thereto. For example, a support member having substantially an L-shape in planar view may be used. In this case, the L-shaped support member is attached to edge portions of the other two sides than two sides of the edge portions 12A to 12D of the four sides of the diaphragm 12.

Figure 10:
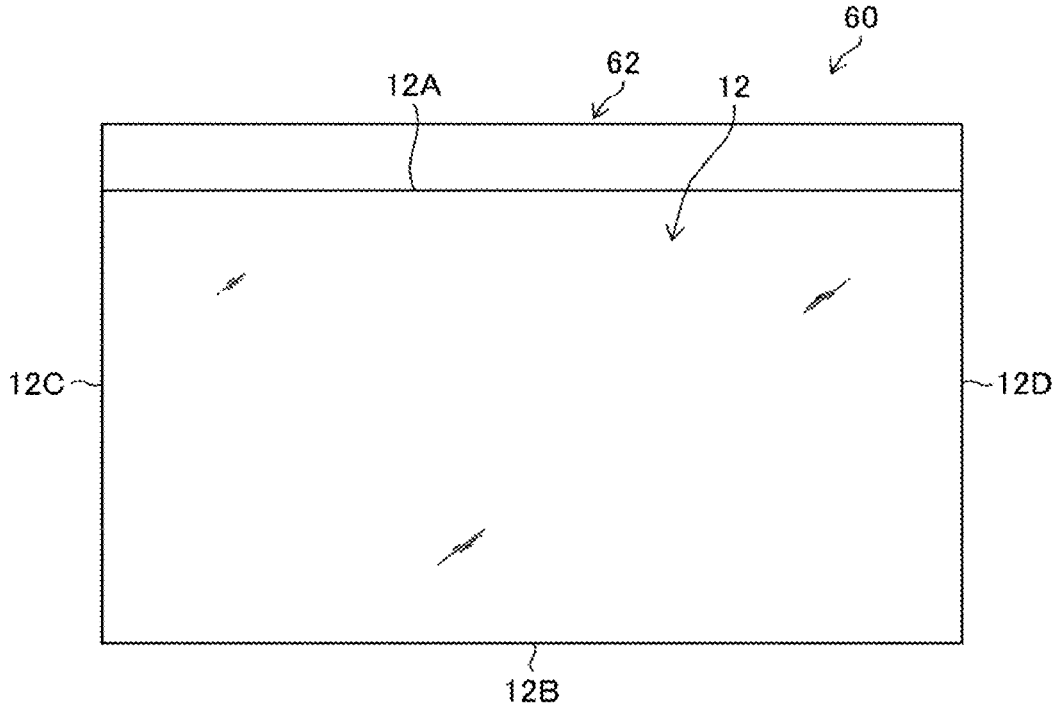
FIG. 10 is a plan view of a glass sheet composite illustrating a modification of the glass sheet composite.

FIG. 10 is a plan view of a glass sheet composite 60 illustrating a modification of the glass sheet composite according to the second embodiment.

The glass sheet composite 60 in FIG. 10 is formed so that at least one edge portion (for example, the upper edge portion 12A) of the diaphragm 12 is supported on a support member 62 of a solid plate. The glass sheet composite 60 in FIG. 10 is a glass sheet composite suitable for a wall, a ceiling, a handrail or a smoke-proof hanging wall.

The diaphragm 12 has a configuration in which the lower edge portion 12B, the left edge portion 12C and the right edge portion 12D are not supported on the support member 62 so that vibration of the lower edge portion 12B, the left edge portion 12C and the right edge portion 12D is not transmitted to the support member 62. Even the glass sheet composite 60 thus configured has excellent acoustic performance because vibration transmitted from the diaphragm 12 to the support member 62 can be reduced.

In the glass sheet composite 60, the support structure between the diaphragm 12 and the support member 62 is not limited. For example, the diaphragm 12 may be attached through a seal material, or may be attached through the fixing parts 22 shown in FIG. 4 and FIG. 5 and the vibration-permitting parts 24 shown in FIG. 6 to FIG. 8. In this manner, vibration transmitted from the diaphragm 12 to the support member 62 can be further reduced.

Figure 11:
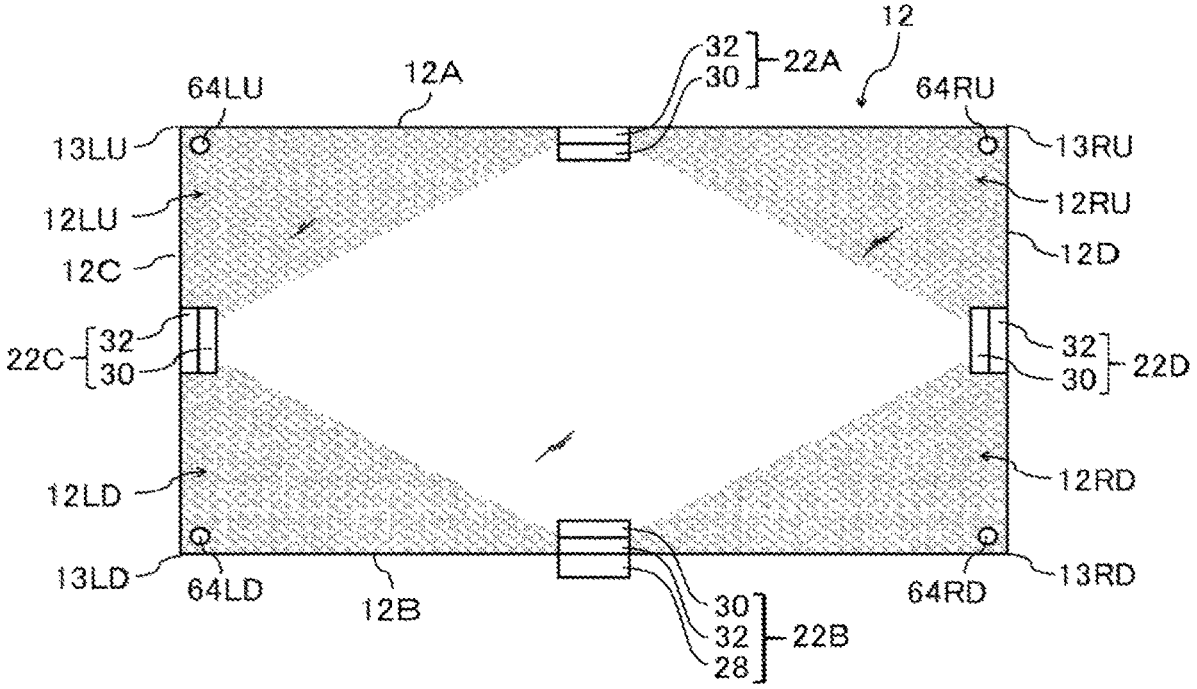
FIG. 11 is a front view of a diaphragm illustrating positions where fixing sections and vibrators are disposed with respect to the diaphragm.

FIG. 11 is a front view of the diaphragm 12 illustrating an example of positions where the fixing parts 22 and vibrators 64LU, 64 LD, 64RU and 64RD are disposed relative to the diaphragm 12.

The diaphragm 12 in FIG. 11 has fixing parts 22A to 22D provided at central portions of the upper edge portion 12A, the lower edge portion 12B, the left edge portion 12C and the right edge portion 12D respectively. The vibrator 64LU is attached to a left upper corner portion 13LU of the diaphragm 12. The vibrator 64LD is attached to a left lower corner portion 13LD. The vibrator 64RU is attached to a right upper corner portion 13RU. The vibrator 64 RD is attached to a right lower corner portion 13RD.

According to the diaphragm 12 thus configured, a diaphragm 12LU having a triangular region with the vibrator 64LU, the fixing part 22A and the fixing part 22C as apexes can be vibrated independently when the vibrator 64LU is driven. In the same manner, a diaphragm 12LD having a triangular region with the vibrator 64LD, the fixing part 22B and the fixing part 22C as apexes can be vibrated independently when the vibrator 64LD is driven. In the same manner, a diaphragm 12RU having a triangular region with the vibrator 64RU, the fixing part 22A and the fixing part 22D as apexes can be vibrated independently when the vibrator 64RU is driven. In addition, a diaphragm 12RD having a triangular region with the vibrator 64RD, the fixing part 22B and the fixing part 22D as apexes can be vibrated independently when the vibrator 64RD is driven.

According to the diaphragm 12 in FIG. 11, the diaphragms 12LU, 12LD, 12RU and 12RD corresponding to four diaphragms can be obtained from a single diaphragm. When the vibrators 64LU, 64LD, 64RU and 64RD are localized and controlled, a stereo sound field with feelings of expansion and depth can be provided.

Although the present invention has been described in detail and with reference to its specific embodiments, it is obvious for those skilled in the art that various changes or modifications can be made without departing from the spirit and scope of the present invention.

The present application is based on Japanese Patent Application No. 2017-065571 filed on Mar. 29, 2017, the contents of which are incorporated herein by reference.

REFERENCE SIGNS LIST

10 . . . glass sheet composite, 12 . . . diaphragm, 12A-12D . . . edge portion, 12LU, 12LD, 12RU, 12RD . . . diaphragm, 13 . . . corner portion, 14 . . . support member, 14A-14D . . . frame, 16 . . . liquid layer, 18,20 . . . glass sheet, 22 . . . fixing part, 22A-22D . . . fixing part, 24 . . . vibration-permitting part, 26L . . . left vibrator, 26R . . . right vibrator, 28 . . . setting block, 30 . . . seal material, 32 . . . block, 34 . . . backer, 36 . . . space, 38 . . . backer, 40 . . . hollow gasket, 50 . . . glass sheet composite, 52 . . . support member, 60 . . . glass sheet composite, 62 . . . support member, 64LU,64LD,64LD,64RD . . . vibrator

The invention claimed is:

1. A glass sheet composite, comprising:

a diaphragm comprising at least one glass sheet and having a front surface and a back surface opposite to the front surface, the diaphragm configured to be vibrated by a vibrator; and a support member attached along an edge portion of the diaphragm and formed to have a U-shape in section, wherein the diaphragm is supported on the support member through a plurality of fixing parts that fixes the edge portion of the diaphragm to the support member, and a vibration-permitting part that permits vibration of the diaphragm, the fixing parts are disposed intermittently along the edge portion of the diaphragm, and at least one of the fixing parts comprises a pair of blocks made of hard rubber, one being fitted between the front surface of the diaphragm and the support member, and the other being fitted between the back surface of the diaphragm and the support member.

2. The glass sheet composite according to claim 1, wherein:

the diaphragm is formed into a rectangular shape such that the diaphragm has four edge portions in four sides of the rectangular shape, respectively; and the support member is formed into a frame-like body which can be attached along the four edge portions of the diaphragm.

3. The glass sheet composite according to claim 1, wherein:

the diaphragm is formed into a rectangular shape having edge portions in four sides thereof; and the support member is formed into a solid plate which can be attached to one side of the diaphragm.

4. The glass sheet composite according to claim 1, wherein the fixing parts are disposed in the edge portion of the diaphragm near a corner portion of the diaphragm.

5. The glass sheet composite according to claim 1, wherein an area where the plurality of the fixing parts are disposed in the edge portion of the diaphragm is smaller than an area where the vibration-permitting part occupies in the edge portion of the diaphragm.

6. The glass sheet composite according to claim 1, wherein at least one of the fixing parts comprises a setting block on which the edge portion of the diaphragm is mounted, and a seal material which fixes the edge portion of the diaphragm to the support member.

7. The glass sheet composite according to claim 1, wherein the vibration-permitting part is a soft backer that is disposed between the edge portion of the diaphragm and the support member.

8. The glass sheet composite according to claim 1, wherein the vibration-permitting part is a soft gasket that is disposed between the edge portion of the diaphragm and the support member.

9. The glass sheet composite according to claim 1, wherein the vibration-permitting part is a space that is formed between the edge portion of the diaphragm and the support member.

10. A glass sheet composite, comprising:

a diaphragm comprising at least one glass sheet and having a front surface and a back surface opposite to the front surface, the diaphragm configured to be vibrated by a vibrator, where the diaphragm is formed into a rectangular shape such that the diaphragm has four edge portions in four sides of the rectangular shape, respectively; and a support member attached along one, two, or three of the edge portions of the diaphragm and formed to have a U-shape in section, wherein the diaphragm is supported on the support member through a plurality of fixing parts that fixes the edge portion of the diaphragm to the support member, and a vibration-permitting part that permits vibration of the diaphragm, the fixing parts are disposed intermittently along the edge portions of the diaphragm attached to the support member, and at least one of the fixing parts comprises a pair of blocks made of hard rubber, one being fitted between the front surface of the diaphragm and the support member, and the other being fitted between the back surface of the diaphragm and the support member.

11. The glass sheet composite according to claim 1, wherein the diaphragm has a loss coefficient at 25° C. of $1\times10^{-2}$ or more and a longitudinal wave acoustic velocity in a sheet thickness direction of $5.0\times10^{3}$ m/s or more.

12. The glass sheet composite according to claim 1, wherein the diaphragm includes a plurality of glass sheets, and a liquid layer is provided between at least a pair of glass sheets out of the plurality of glass sheets.

13. The glass sheet composite according to claim 1, wherein the hard rubber is chloroprene rubber, EPDM rubber, or silicone rubber.

14. The glass sheet composite according to claim 7, wherein the soft backer has a rubber hardness of 20-50 degrees measured according to JIS K6253 (2012).

15. The glass sheet composite according to claim 8, wherein the soft gasket is a hollow gasket having a rubber hardness of 20-70 degrees measured according to JIS K6253 (2012).

16. The glass sheet composite according to claim 15, wherein the hollow gasket comprises silicone sponge, silicone rubber, EPDM rubber, or chloroprene rubber.

17. The glass sheet composite according to claim 2, wherein the diaphragm is supported on the support member through four fixing parts each provided at a central portion of each of the four edge portions of the diaphragm.

18. The glass sheet composite according to claim 17, wherein the vibrator is attached to each of four corner portions of the diaphragm.

19. An opening member of a vehicle, comprising:

the glass sheet composite according to claim 1.

* * * * *